US011982059B1

(12) United States Patent
DelSignore et al.

(10) Patent No.: US 11,982,059 B1
(45) Date of Patent: May 14, 2024

(54) BRIDGE OVERHANG SHIELDING AND FORMWORK

(71) Applicant: Swank Construction Company, LLC, New Kensington, PA (US)

(72) Inventors: William DelSignore, Monroeville, PA (US); Louis R. Schultheis, East Brady, PA (US); Gregory Stahl, Somerset, PA (US); Andrew R. Swank, Gibsonia, PA (US)

(73) Assignee: Swank Construction Company, LLC, New Kensington, PA (US)

( * ) Notice: Subject to any disclaimer, the term of this patent is extended or adjusted under 35 U.S.C. 154(b) by 0 days.

(21) Appl. No.: 18/110,438

(22) Filed: Feb. 16, 2023

(51) Int. Cl.
*E01D 21/00* (2006.01)
*E01D 19/10* (2006.01)
*E01D 22/00* (2006.01)

(52) U.S. Cl.
CPC ..... *E01D 21/00* (2013.01); *E01D 19/10* (2013.01); *E01D 22/00* (2013.01)

(58) Field of Classification Search
CPC ..... E01D 19/236; E01D 19/286; E01D 21/00
USPC ..... 14/77.1, 78; 182/148–150
See application file for complete search history.

(56) References Cited

U.S. PATENT DOCUMENTS 4,260,126 A * 4/1981 Schreck ..... E01D 19/125 249/20
5,549,176 A * 8/1996 Hawkins ..... E01D 21/00 182/63.1
8,136,191 B2 * 3/2012 Jorkama-Lopez .... E01D 19/106 14/78
8,550,213 B2 * 10/2013 Jorkama-Lopez ..... E04G 13/06 182/112
11,339,563 B2 * 5/2022 Brodowski ..... E01D 19/125
2005/0199441 A1 9/2005 Thery
2007/0056799 A1 3/2007 Leidner
2009/0223743 A1 * 9/2009 Jejina ..... E04G 5/04 248/235
2011/0120800 A1 * 5/2011 Depot ..... E04G 5/048 182/113

FOREIGN PATENT DOCUMENTS

DE 3925518 * 2/1991 ..... E04G 3/08
FI 20205763 A1 * 1/2022 ..... E01D 19/10

* cited by examiner

*Primary Examiner* — Raymond W Addie
(74) *Attorney, Agent, or Firm* — Dentons Cohen & Grigsby P.C.

(57) ABSTRACT

A bracket attachable to a top side of a parapet on a bridge to support a platform positioned on a horizontal element of the bracket. Vertical adjustment of the bracket allows the horizontal element to be positioned a small distance beneath the bridge deck so that the platform positioned thereon can catch falling materials, such as from demolition during bridge repair. After demolition, vertical adjustment of the bracket brings the horizontal element supporting the platform to a level directly under the bridge deck for use as a formwork for construction of a new roadway.

20 Claims, 5 Drawing Sheets

BRIDGE OVERHANG SHIELDING AND FORMWORK

TECHNICAL FIELD

This invention relates generally to a support brackets, such as support brackets attachable to a parapet of a bridge or an elevated roadway, that provide support for a platform useful as a demolition shield below the bridge or roadway and as formwork for reconstruction of the bridge or roadway.

BACKGROUND

Expansion joints on a bridge provide a gap that allows for bridge movement, due primarily to temperature changes; bridges typically expand in warm weather and contract in cool weather. A bridge may also move under load and/or due to properties of the construction materials.

Expansion joints typically include a gap in the roadway surface, i.e., bridge deck, that is either closed to protect the portion of the bridge directly below the opening, or open. Open joints are common in older bridges and typically allow drainage to flow through the joint and down onto bridge components below, or into a drainage trough positioned below the joint. Wear on the regions of the bridge deck abutting the expansion joint, i.e., the header or nosing, and deterioration of the material in the expansion joint can lead to failure of the joint system and significant deterioration of the bridge deck and bridge girders.

Repair of the bridge decking surrounding an expansion joint can be a dangerous process as portions of the bridge deck and the side rails, i.e., parapets, are removed, exposing regions below to falling debris and the worker to unsafe conditions. During demolition of these portions of the bridge, scaffolding is constructed to support platforms that may catch the falling debris. The scaffolding also provides support and protection for workers during demolition and reconstruction.

Prior art scaffolding is generally built for each construction project, being designed for the specific dimensions of the bridge and parapet. For example, the height and width of the parapets, and the distance the bridge is cantilevered over the pier supports or girders is specific to the bridge and is non-standardized.

Accordingly, improved scaffolding brackets and scaffolding systems that may be adjustable to allow for use on a wide range of elevated roadways and bridges are desirable.

SUMMARY

The present disclosure relates to brackets configured to provide support for a platform or formwork useful during demolition and/or construction of a raised roadway, such as a bridge surface. The brackets are adjustable in both the horizontal and vertical dimensions and are thus useful on a wide range of bridge designs. Moreover, adjustment of the brackets disclosed herein allows them to be used as platforms to catch falling debris and as formwork for reconstruction of the roadway, e.g., bridge deck and parapets.

Accordingly, provided herein is a bracket comprising a first telescoping support having an adjustable longitudinal extent defined by first and second ends, and a second telescoping support having an adjustable longitudinal extent defined by first and second ends, wherein the second telescoping support is attached to the first telescoping support perpendicular thereto.

The first telescoping support generally comprises first and second segments, wherein the first segment is moveable axially within the second segment to adjust the longitudinal extent of the first telescoping support.

The second telescoping support may comprise first and second segments, wherein the first segment is moveable axially within the second segment to adjust the longitudinal extent of the second telescoping support. The second segment of the second telescoping support may be attached to the first segment of the first telescoping support at a 90-degree angle, i.e., perpendicular to each other.

The first telescoping support includes a tensioning rod positioned within an interior of the first and second segments and extending through openings at opposing ends of the first and second segments. Each end of the tensioning rod includes an adjustment element configured to secure the longitudinal extent of the first telescoping support at a defined length.

The first telescoping support further includes an attachment extension positioned on the second segment adjacent the first end of the first telescoping support and extending perpendicularly therefrom. The attachment extension generally includes an aperture configured to accept an attachment element used to secure the bracket to a top surface of a parapet on a bridge or raised roadway.

Also provided herein is a bridge overhang shielding and formwork comprising two brackets as described herein, and formwork positionable on the second telescoping support and spanning a distance between the two brackets to provide a horizontal support. As example, the first telescoping support can be positioned on an outer side of a parapet on an elevated road surface with the attachment extension resting on a top of the parapet, and the longitudinal extent of the first telescoping support may be adjusted to position the formwork adjacent an underside of a bridge deck.

Also provided herein are methods for assembling a bridge overhang shielding and formwork using the brackets described herein.

BRIEF DESCRIPTION OF THE DRAWINGS

Aspects, features, benefits, and advantages of the embodiments herein will be apparent with regard to the following description, appended claims, and accompanying drawings. In the following figures, like numerals represent like features in the various views. It is to be noted that features and components in these drawings, illustrating the views of embodiments of the present invention, unless stated to be otherwise, are not necessarily drawn to scale.

DETAILED DESCRIPTION

The demolition of a bridge deck and its associated parapets for repair or replacement benefits greatly from scaffolding to support shielding or platform materials, typically plywood sheets, to protect regions under the bridge from falling debris. In general, the scaffolding is designed and configured for the unique dimensions of the bridge or elevated roadway under repair. Moreover, after demolition is complete, construction of the new bridge deck requires formwork, such as forms used for pouring cement or concrete. Thus, the scaffolding used to provide shielding during demolition must be removed and replaced with scaffolding configured to support formwork. Alternatively, additional layers of formwork may be included so that the new road surface is correctly positioned, adding to the expense of the project.

The present disclosure provides novel brackets that are adjustable vertically and horizontally. The bracket is attachable to a top side of a parapet on a bridge or elevated roadway and includes a horizontal element positionable below the bridge deck that supports a platform to catch falling materials, such as from demolition during bridge repair. Vertical adjustment of the bracket during installation allows the horizontal element to be positioned variable distances beneath the bridge deck. Thus, after demolition, the bracket may be adjusted vertically to bring the horizontal element supporting the platform up to a level directly under the bridge deck for use as a formwork for construction of the new roadway. As such, not only do the novel brackets provide a near universal system to support shielding and formwork on a bridge or elevated roadway, but they also reduce the expense and time for completing a project. Transitioning from demolition to construction requires only a simple adjustment of the bracket to reposition the platform, which may now serve as formwork.

Figure 1:
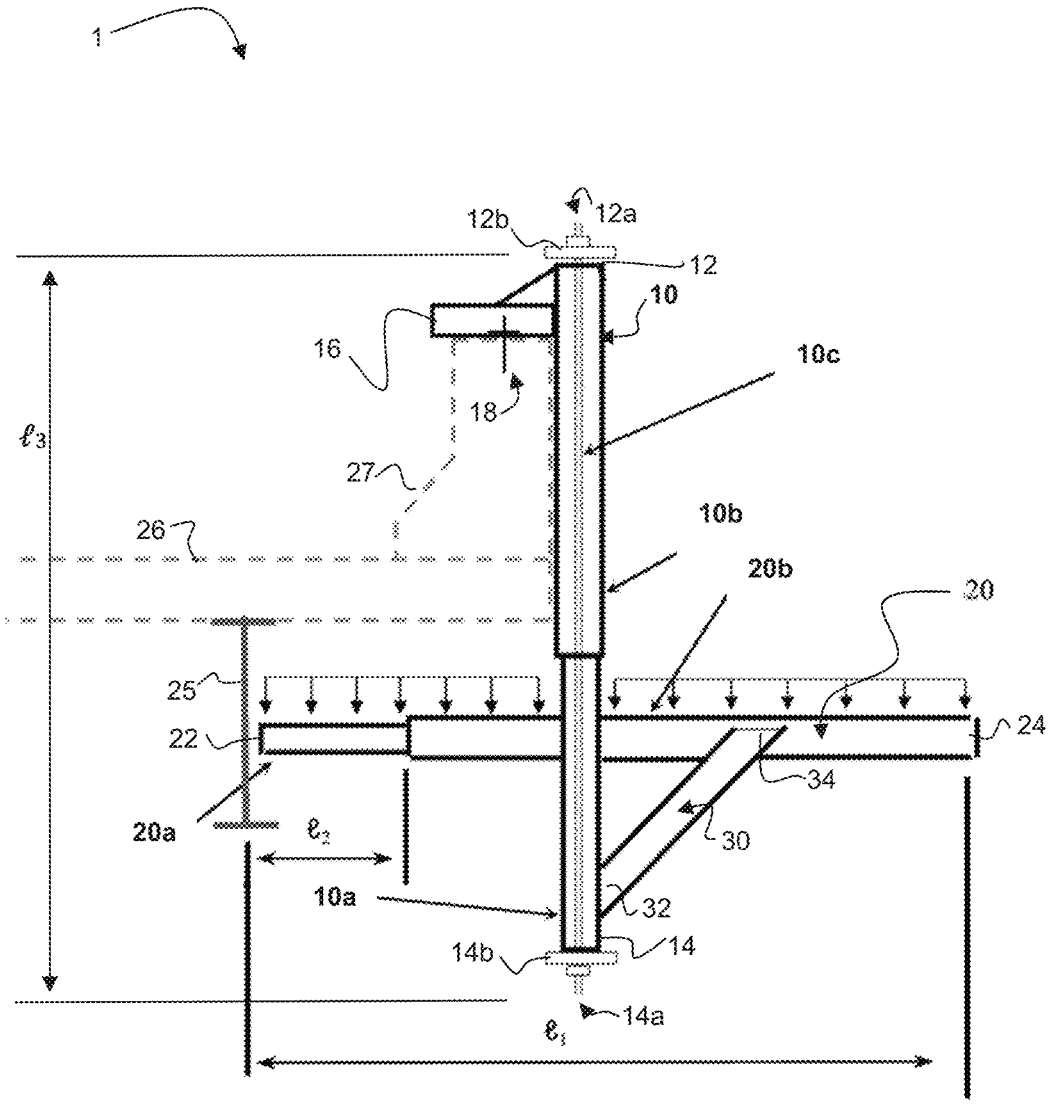
FIG. 1 illustrates a bracket according to aspects of the present disclosure.

Referring now to the drawings, FIG. 1 illustrates a bracket 1 according to the present disclosure. The bracket 1 includes a first telescoping support 10 attached to a second telescoping support 20 perpendicular thereto. The first telescoping support 10 has an adjustable longitudinal extent $l_3$ defined by first and second ends (12 and 14, respectively). The second telescoping support 20 has an adjustable longitudinal extent $l_1$ defined by first and second ends (22 and 24, respectively). This bi-directional adjustment allows the bracket 1 to be configured for a wide range of parapet 27 heights and deck 26 cantilever extensions (distance the bridge deck extends past a supporting girder 25).

The first telescoping support 10 may comprise a first segment 10 that is moveable axially within a second segment 10*b* to adjust the longitudinal extent $l_3$ of the first telescoping support. The first telescoping support 10 further includes a tensioning rod 10*c* positioned within an interior of the first and second segments (10*a* and 10*b*, respectively) that may secure the longitudinal extent $l_3$ at a defined length. For example, as shown in FIG. 1, the longitudinal extent $l_3$ of the first telescoping support 10 is adjusted so that the second telescoping support 20 is positioned parallel with the bridge deck 26 at a distance separated therefrom.

The ends (12*a*, 14*a*) of the tensioning rod 10*c* extend through openings at opposing ends (12, 14, respectively) of the first telescoping support 10 (i.e., ends of the first and second segments 10*a* and 10*b*, respectively). An adjustment element (12*b*, 14*b*) may be engaged with one or both ends of the tensioning rod 10*c*. For example, the tensioning rod may include internally threaded regions at ends thereof configured to accept externally threaded anchors or adjustment elements. Alternatively, the tensioning rod may include an externally threaded region that may engage with an internally threaded anchor or adjustment element, such as shown in FIG. 1. The entire tensioning rod may be threaded, or only a portion at each end thereof. In this instance, the adjustment elements may include a threaded nut that may be rotatably connectable with the complementary threaded region on the tensioning rod.

The adjustment elements (12*b*, 14*b*) may include exterior structures, such as on an end thereof, that are configured to engage with a tool, such as a wrench, spanner, screwdriver, crowbar, and the like. As the opening in the end of each of the first and second segment of the first telescoping support is smaller than the attachment element, a longitudinal extent of the first telescoping support becomes limited by the position of the adjustment elements on the tensioning rod 10*c*.

While described and shown as including an adjustment element (12*b*, 14*b*) at each end of the tensioning rod 10*c*, only one adjustment element may be used. For example, a first end 12*a* of the tensioning rod 10*c* adjacent the first end 12 of first telescoping support 10 may include the threaded region (internal or external). The opposite second end 12*b* may then include a permanently attached anchor, much as a screw head or bolt head that extends through the opening in the adjacent the second end 14 of the first telescoping support 10 (i.e., opening in the first segment 10*a*), or may be welded to the first segment 10*a*.

With continued reference to FIG. 1, the second telescoping support 20 may comprise a first segment 20*a* that is moveable axially within a second segment 20*b* to adjust the longitudinal extent $l_1$ of the second telescoping support. The first segment 20*a* may be pulled or extended out of the second segment 20*b* a distance 12, i.e., extended toward the middle of the bridge deck 26, such as to a position abutting a girder 25 of the bridge. The longitudinal extent $l_1$ of the second telescoping support 20 may be secured at such a length to provide maximum coverage beneath the bridge deck 26 to collect falling debris and may provide additional stability to the bracket 1 when installed on a parapet 27, i e., counter the horizontal force exerted when a load is positioned adjacent the second end 24 of the second telescoping support 20.

The second segment 20*b* of the second telescoping support 20 is attached to the first segment 20*a* of the first telescoping support 10. In this way, the tensioning rod 10*c* in the first telescoping support 10 may be used to adjust a position of the second telescoping support 20 relative to the first end 12 of the first telescoping support 10, i.e., raise and lower the second telescoping support when installed on a bridge parapet.

The bracket 1 further includes a diagonal support beam 30 that provides additional structural support when the second telescoping support 20 is under load, e.g., when in use with platform panels and supporting a worker. A first end 32 of the diagonal support beam 30 is attached to the first segment 10*a* of the first telescoping support 10 adjacent an end thereof, and a second end 34 of the diagonal support beam 30 is attached to a bottom side of the second segment 20*b* of the second telescoping support 20. Such an arrangement offers the maximum support for loads place adjacent the second end 24 of the second telescoping support 20 and does not interfere with placement of a platform on a top side of the second telescoping support 20.

The bracket 1 further yet includes an attachment extension 16 positioned on the second segment 10*b* adjacent the first end 12 of the first telescoping support 10 and extending perpendicularly therefrom. Moreover, the attachment extension 16 is attached to the first telescoping support 10 on a side opposite from the diagonal support beam 30. The attachment extension 16 may include an aperture configured to accept an attachment element 18 to secure the bracket 1 to a top surface of a parapet. Exemplary attachment elements 18 include at least screws, nails, bolts, and the like.

Figure 2:
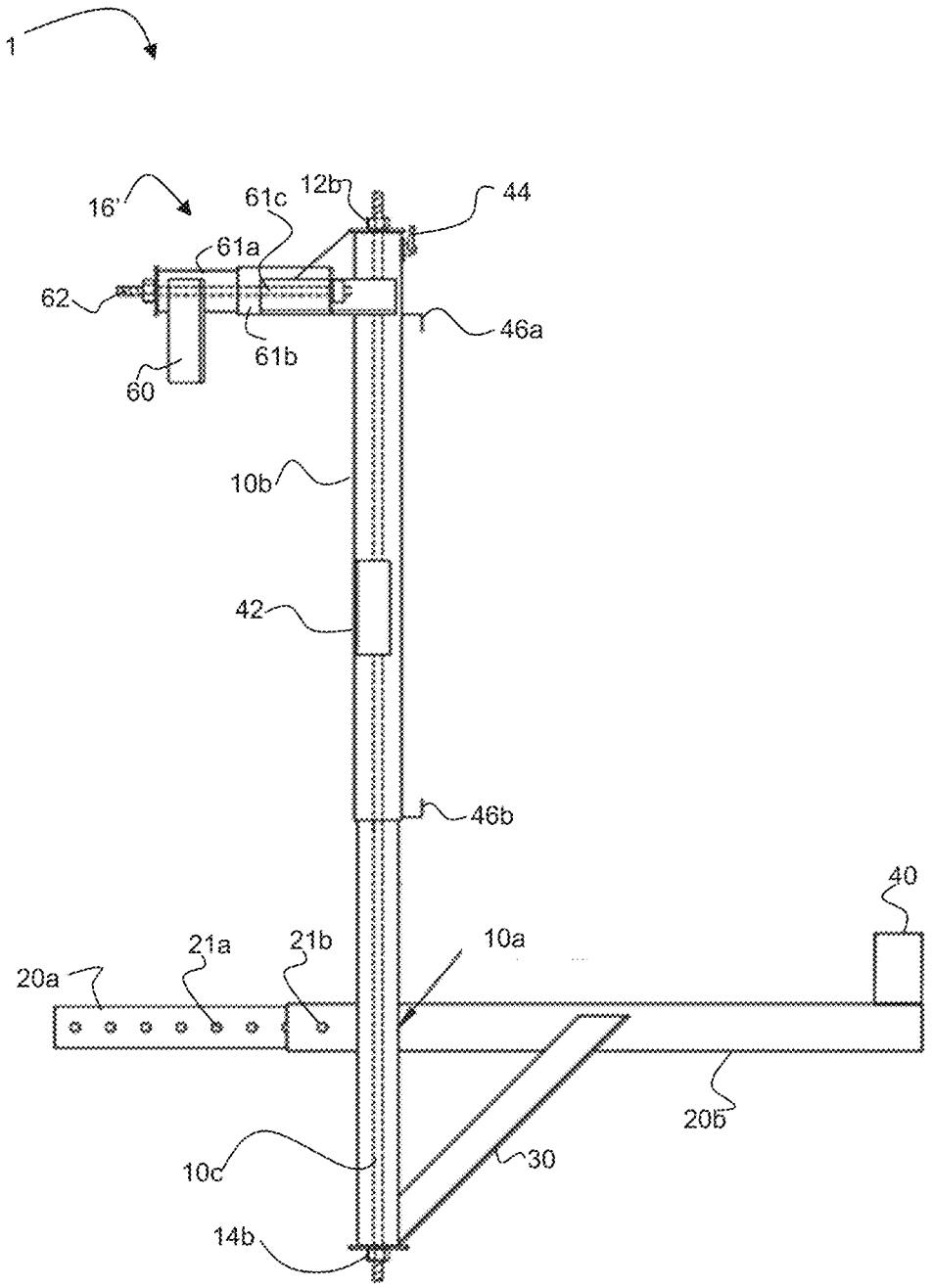
FIG. 2 illustrates a bracket according to aspects of the present disclosure.

The longitudinal extent it of the second telescoping support 20 may be adjusted using a tensioning rod as described for the first telescoping support. Alternatively, and as shown in FIG. 2, the first segment 20*a* of the second telescoping support 20 may comprise a plurality of apertures 21*a* positioned along a longitudinal length thereof, and the second segment 20*b* may comprise an aperture 21*b* adjacent a first end that is alignable with one of the plurality of apertures 21*a* on the first segment 20*a*. The longitudinal extent $l_1$ of the second telescoping support 20 may be secured at a defined length by positioning a fastener through aligned apertures on the first and second segments. Exemplary fasteners include cotter pins, Clovis pins, hitch pins, nuts and bolts, and the like.

With continued reference to FIG. 2, the attachment extension 16' may also be configured to include a first segment 61*a* that is moveable axially within a second segment 61*b* so that a length of the attachment extension 16' may be varied, such as to accommodate varied widths of the top surface of a parapet. A length of the attachment extension 16' may be secured at a desired extent via a tensioning rod 61*c* positioned within an interior of the first and second segments (61*a*, 61*b*). Ends of the tensioning rod 61*c* extend through openings at opposing ends of the attachment extension 16'. At least a first end 62 of the tensioning rod may include an adjustment element, such as a threaded nut that may be rotatably connectable with a complementary threaded region on the tensioning rod 61*c*. As the opening in the end of the first segment 61*a* is smaller than the attachment element, a longitudinal extent of the attachment extension 16' becomes limited by the position of the adjustment element on the tensioning rod. The tensioning rod 61*c* of the attachment extension 16' may include an adjustment element at the second end thereof. Moreover, the entire tensioning rod 61*c* may be threaded, or only a portion at each end thereof.

The attachment extension 16' may further include a secondary attachment extension 60 attached to the first segment 61*a* and extending perpendicularly downward therefrom. As such, a length of the attachment extension 16' may be adjusted so that the parapet is positioned snugly between the secondary attachment extension 60 and the second segment 10*b* of the first telescoping support, at least adjacent the top side thereof.

The bracket 1 may be further secured to the parapet of a bridge or elevated roadway via an anchor plate 42 positioned on the second segment 10*b* of the first telescoping support 10. The anchor plate 42 may include apertures configured to accept an attachment element 18 to secure the first segment to an outer vertical side of the parapet.

The first and second telescoping support, attachment extension, and diagonal support beam of the bracket 1 are generally formed of structural metal, such as steel or a material of equivalent strength (e.g., aluminum). For example, the first and second telescoping support, attachment extension, and diagonal support beam may be formed of 4×4 inch or 5×5 inch square steel tube. The tubing may have a wall thickness of 3/16 inch. Thus, as example, the second telescoping support, i.e., outer tubes, may be formed of 4 inch×4 inch×3/16 inch hollow structural section and the first telescoping support, i.e., inner tubes, may be formed of 32 inch×3% inch×3/16 inch hollow structural section. Certain components of the bracket described herein, such as the anchor plate, and in some instances the attachment extension, may be formed of steel plate or an equivalent material.

Figure 3:
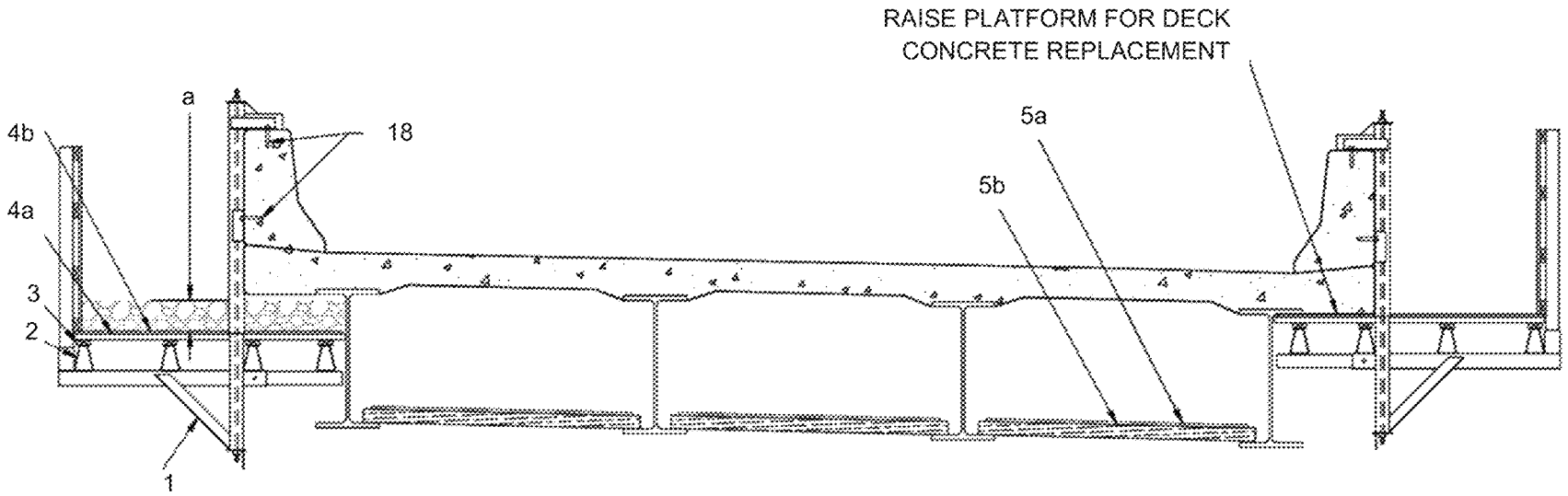
FIG. 3 illustrates a cross section of a bridge with a bracket secured on a parapet and positioned to support a platform a distance below a roadway surface (at left) or a formwork directly below a surface on which a roadway is being constructed (at right).
Figure 4:
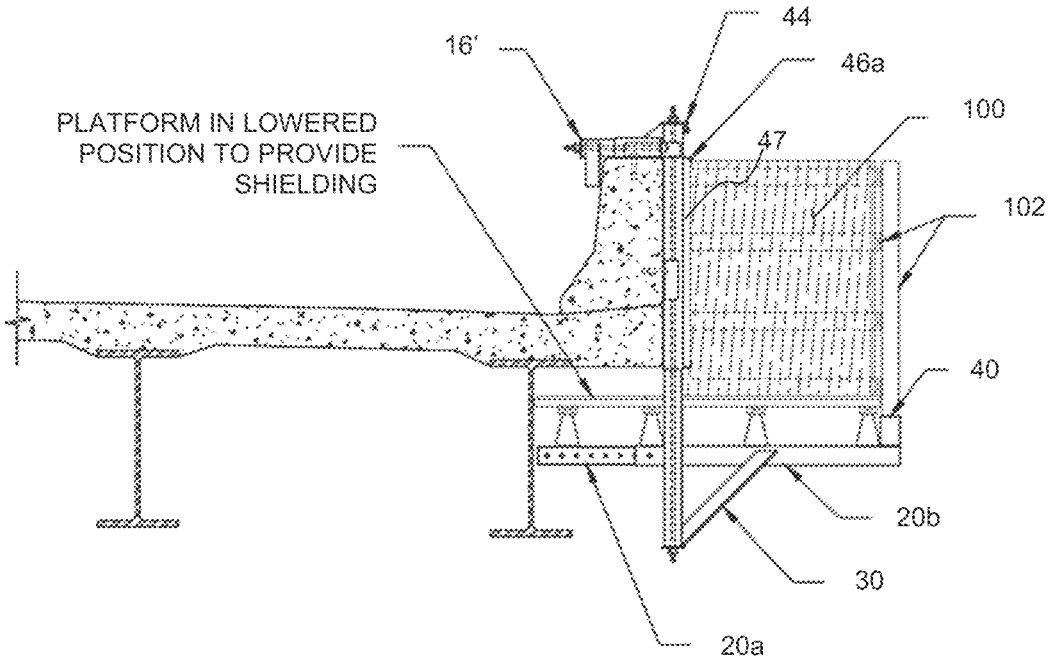
FIG. 4 illustrates a closeup view of the bridge cross-section and bracket shown at left in FIG. 3 with formwork and guardrails attached, wherein the bracket is secured on a parapet with a horizontal support in a lowered position to support a platform a distance below the roadway surface.
Figure 5:
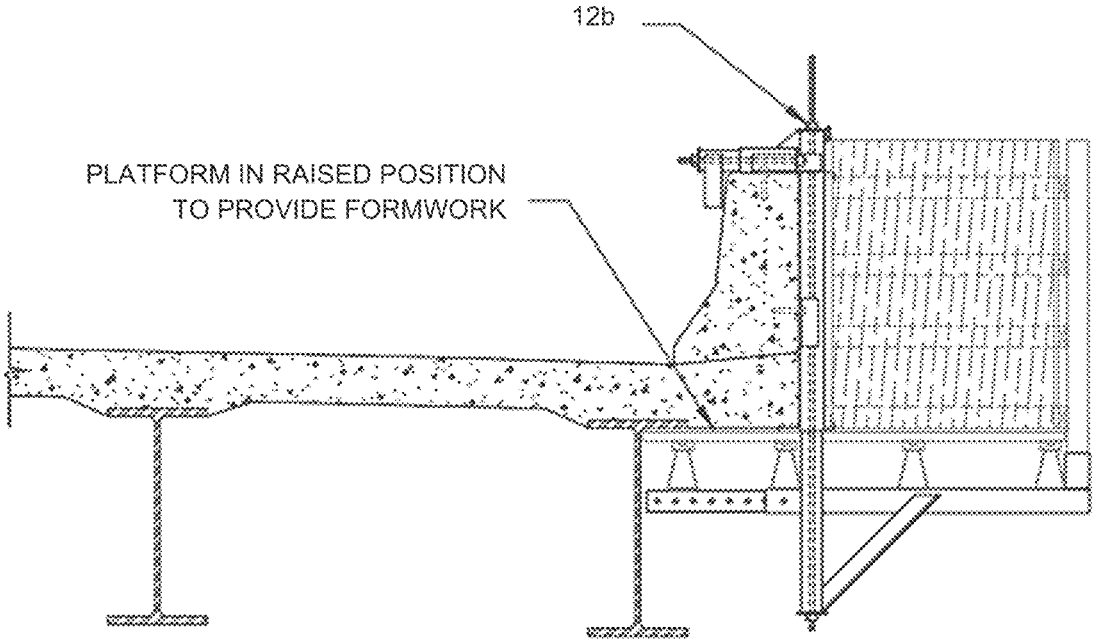
FIG. 5 illustrates a closeup view of the bridge cross-section and bracket shown at right in FIG. 3 with formwork and guardrails attached, wherein the bracket is secured on a parapet with the horizontal support in a raised position to support the formwork directly below the roadway surface.

With reference to FIGS. 3-5, a cross section of a bridge is shown. Brackets 1 of the present disclosure are shown attached to parapets on a bridge along an outside face thereof. The bracket 1 attached to a parapet on the left side of the bridge is shown to include attachment elements 18 positioned through the attachment extension (16, 16') on the top surface of the parapet and an anchor plate 42 along an outer vertical face of the parapet (see left side of FIG. 3 and FIG. 4). The first telescoping support 10 is extended to position the second telescoping support (20*a*, 20*b*) a distance below the bottom surface of the bridge deck to support shielding panels that may collect debris (a) from demolition of regions of the bridge deck and parapet.

The bracket 1 attached to a parapet on the right side of the bridge is shown in a raised position, wherein the platform is positioned directly under the bridge deck (see right side of FIG. 3 and FIG. 5). The adjustment element at the first end 12*a* of the tensioning rod 10*c* is used to shorten the first telescoping support 10 to position the second telescoping support (20*a*, 20*b*) directly below the bottom surface of the bridge deck. The second telescoping support (20*a*, 20*b*) may now support panels that act as formwork for reconstruction of regions of the bridge deck and parapet, such as formwork for pouring cement or concrete, or other road surface materials known in the art.

To act as a scaffold on a bridge or elevated roadway, two or more brackets may be attached to the bridge as described and spaced apart from each other to support shielding or formwork panels or a platform 4*b* across adjacent horizontally positioned second telescoping supports (20). The platform 4*b* may be positioned over joists 4*a* and/or wood nailer beams 3 and/or support beams 2, depending on the diameter of the span between the adjacent brackets and the expected loads the platform is expected to carry. Also shown in FIG. 3 are the platforms 5*a* and joists 5*b* positioned on girders supporting the bridge deck that act as shielding to collect falling debris from demolition of the bridge deck. Exemplary nailer beams 3 and joists 4*a* include dimensional lumber. For example, exemplary nailer beams 3 may be as 2×4 lumber and exemplary joists 4*a* may be 2×6 lumber, as is known in the an. Exemplary platform material 4*b* includes plywood, although any flat sturdy material may be used. Exemplary support beams 2 include steel or galvanized steel beams.

The bracket 1 may include attachment elements that provide for additional framing or shielding components, such as railings and the like, that may further protect areas below the bridge deck from falling debris and may also protect the worker from accidental falls. As shown in FIG. 2, the second segment 10*b* of the first telescoping support 10 may include nailer pockets (46*a*, 46*b*) configured to accept ends of a nailer beam 47 (e.g., dimensional lumber such as a 2×4, see in FIG. 4). The nailer pockets (46*a*, 46*b*) may be positioned adjacent opposing ends of the second segment 10*b* on a side thereof that faces away from the parapet when the bracket 1 is attached to the parapet. The nailer pockets (46*a*, 46*b*) are typically outwardly extending hooks with an opening sized and configured to accept ends of the nailer beam 47, i.e., openings face toward each other to provide attachment of the nailer beam on the second segment 10*b*.

The bracket 1 may also include a guardrail pocket 40 at the second end 24 of the second telescoping support 20. The guardrail pocket 40 is typically an upward facing cup-shaped pocket that is sized and configured to accept an end of a length of dimensional lumber, e.g., a 2×4. With reference to FIG. 4, a side view of a bracket 1 is shown, wherein a nailer beam 47 is attached between top and bottom nailer pockets (46*a* and 46*b*, respectively), and a guardrail 102 is positioned within the guardrail pocket 40. Between the nailer beam 47 and the guardrail 102, and guardrails on adjacent brackets, additional rails may be attached to provide a side railing that extends around all three exposed sides of the platform. The guardrails are typically constructed to be at least 38 inches tall, as measure from the top surface of the platform, such as 38 inches to 54 inches. According to OSHA standards, guardrails on a scaffold suspended from a parapet should be 38 inches to 45 inches from the platform surface.

Figure 6:
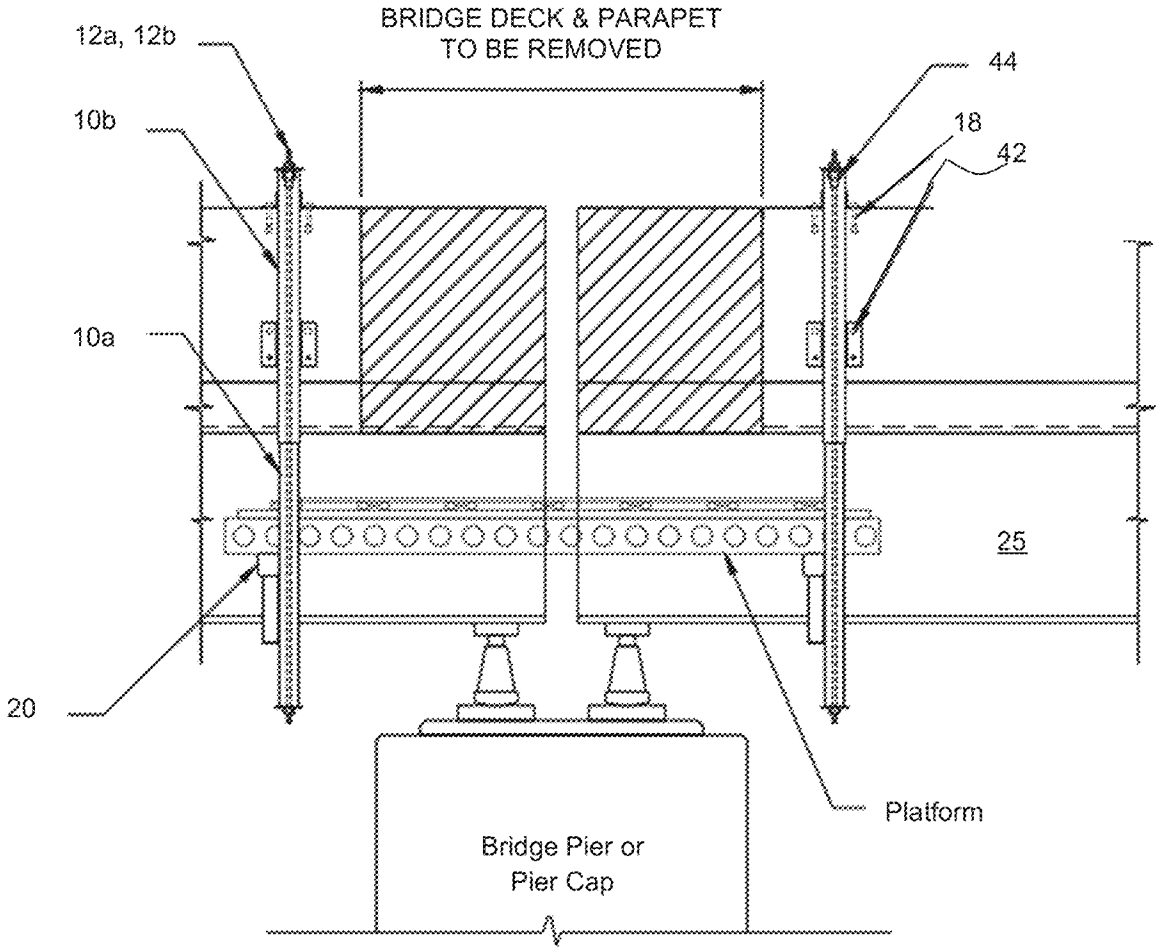
FIG. 6 illustrates a side view of a bridge parapet with brackets according to aspects of the present disclosure positioned on either side of a bridge portion that is being demolished.

With specific reference to FIG. 6, a side view of a bridge is illustrated showing a portion of the bridge deck and parapet abutting each side of an expansion joint that is to be removed and rebuilt. A scaffolding according to the present disclosure is shown to comprise two brackets 1. Each bracket is attached to a top surface of the parapet via the attachment extension (16, 16') and optionally an anchor plate 42, such as by attachment elements 18 through apertures in the attachment extension and anchor plate into the parapet. The platform and additional nailer beams and guardrails may be attached to and between adjacent brackets 1 to provide shielding and formwork as described hereinabove. Thus, the present disclosure also provides a scaffolding for a bridge overhang shielding and formwork that includes two or more brackets 1.

Further, the present disclosure provides bridge overhang shielding and formwork comprising two or more brackets 1 and formwork positionable on the second telescoping support and spanning a distance between the two brackets to provide a horizontal platform. The first telescoping support is positionable on an outer side of a parapet on a bridge or elevated road surface with the attachment extension resting on a top surface of the parapet. Further, the longitudinal extent of the first telescoping support may be adjusted to position the formwork adjacent an underside of a bridge deck.

The present disclosure further provides methods for assembling a scaffolding for a bridge overhang shielding and formwork. The method generally includes attaching two brackets according to claim 1 on a bridge parapet spaced apart from each other, wherein each of the two brackets is attached to a top surface of the bridge parapet by securing an attachment element through the aperture in the attachment extension of the first telescoping support into the top surface of the bridge parapet. The longitudinal extent of the first telescoping support is adjusted so that the second telescoping support is positioned below a bottom surface of a roadway on the bridge, i.e., below a bottom surface of the bridge deck, and spaced apart therefrom. The longitudinal extent of the second telescoping support is then adjusted so that a first end thereof extends beneath the roadway on the bridge, such as to a position abutting a pier of the bridge or a girder supporting the bridge deck.

Adjustment of the longitudinal extent of the first telescoping support generally comprises rotating an adjustment element, e.g., threaded nut, engaged with one of the ends of the tensioning rod. Adjustment of the longitudinal extent of the second telescoping support generally comprises moving the first segment axially within the second segment to adjust the longitudinal extent of the second telescoping support and positioning a fastener through aligned apertures in the first and second segments.

In some instances, a length of the attachment extension of the first telescoping support may be adjusted to cover a substantial width of the top surface before each of the two brackets is attached to the top surface of the bridge parapet. As such, a position of a first segment of the attachment extension that is moveable axially within a second segment may be adjusted to achieve the desired size of the attachment extension.

The above method may be extended to provide a bridge overhang shielding and formwork by further positioning formwork between respective second telescoping supports of adjacent brackets. The formwork may include flat panels of a sturdy material, such as plywood or other similar materials. These panels may be positioned directly on the second telescoping supports, or may be positioned over joists, and/or nailer beams, and/or support beams as shown in FIG. 3. Opposing ends of a nailer beam may be connected within outwardly extending hooks on the second segment of the first telescoping support, wherein the hooks are positioned adjacent opposing ends of the second segment. An end of a guardrail may be positioned in an upwardly directed pocket at the second end of the second telescoping support, wherein the pocket is configured to accept a guardrail positioned vertically. Additional beams may then be attached between the nailer beam and the guardrail on each brackets, and between the guardrails of adjacent brackets to form a side rail that extends around all three open faces of the scaffolding.

While the presently disclosed brackets are described herein as useful to form scaffolding for use on elevated roadways and bridges, and as part of a bridge overhang shielding and formwork, other uses are possible and within the scope of the present disclosure. For example, the brackets may find use in forming any suspended scaffolding, such as scaffolding suspended from a roof or side of a building or other similar structure.

Aspects of the Disclosure

The following aspects are disclosed in this application:

Aspect 1: A bracket comprising a first telescoping support having an adjustable longitudinal extent defined by first and second ends and an attachment extension on the first end thereof, and a second telescoping support having an adjustable longitudinal extent defined by first and second ends, wherein the second telescoping support is attached to the first telescoping support perpendicular thereto, and wherein the attachment extension is positionable on a top surface of a bridge parapet and connectable therewith.

Aspect 2: The bracket according to any previous aspect, wherein the attachment extension is connectable with the top surface of the parapet by securing an attachment element through an aperture in the attachment extension and into the top surface of the bridge parapet.

Aspect 3: The bracket according to any previous aspect, wherein the first telescoping support comprises first and second segments, wherein the first segment is moveable axially within the second segment to adjust the longitudinal extent of the first telescoping support.

Aspect 4: The bracket according to any previous aspect, wherein the first telescoping support comprises a tensioning rod positioned within an interior of the first and second segments and extending through openings at opposing ends of the first and second segments, wherein each end of the tensioning rod includes an adjustment element configured to secure the longitudinal extent of the first telescoping support at a defined length.

Aspect 5: The bracket according to any previous aspect, wherein the attachment extension is positioned on the second segment adjacent the first end of the first telescoping support and extending perpendicularly therefrom, the attachment extension including an aperture configured to accept an attachment element.

Aspect 6. The bracket according to any previous aspect, wherein the second telescoping support comprises first and second segments, wherein the first segment is moveable axially within the second segment to adjust the longitudinal extent of the second telescoping support.

Aspect 7. The bracket according to any previous aspect, wherein the second segment of the second telescoping support is attached to the first segment of the first telescoping support.

Aspect 8: The bracket according to any previous aspect, wherein each end of the tensioning rod of the first telescoping support is threaded, and the adjustment element comprises a threated nut configured to engage the ends of the tensioning rod.

Aspect 9: The bracket according to any previous aspect, wherein the first segment of the second telescoping support comprises a plurality of apertures positioned along a longitudinal length thereof, and the second segment comprises an aperture adjacent a first end that is alignable with one of the plurality of apertures on the first segment, wherein the longitudinal extent of the second telescoping support is secured at a defined length by positioning a fastener through aligned apertures on the first and second segments.

Aspect 10: The bracket according to any previous aspect, comprising a diagonal support beam having a first end connected to the first telescoping support adjacent the second end thereof and a second end connected to the second telescoping support.

Aspect 11: The bracket according to any previous aspect, wherein the attachment extension comprises a secondary attachment extension attached to an end of the attachment extension distal from the first telescoping support, wherein the secondary attachment extension extends perpendicularly downward therefrom.

Aspect 12 The bracket according to any previous aspect, wherein the attachment extension comprises first and second segments, wherein the first segment is moveable axially within the second segment to adjust a longitudinal extent of the attachment extension.

Aspect 13: The bracket according to any previous aspect, wherein the attachment extension comprises a second tensioning rod positioned within an interior of the first and second segments and extending through openings at opposing ends of the first and second segments, wherein each end of the second tensioning rod includes an adjustment element configured to secure a longitudinal extent of the attachment element at a defined length.

Aspect 14: The bracket according to any previous aspect, wherein the second segment of the first telescoping support comprises an anchor plate having apertures configured to accept an attachment element to secure the first segment to an outer vertical side of the parapet.

Aspect 15. The bracket according to any previous aspect, wherein the second segment of the first telescoping support comprises an outwardly extending hook positioned adjacent opposing ends thereof, wherein the hooks are configured to connect a nailer board to the first telescoping support.

Aspect 16: The bracket according to any previous aspect, wherein the second telescoping support comprises an upwardly directed pocket at a second end thereof, wherein the pocket is configured to accept a guardrail.

Aspect 17: A support system for a bridge overhang shielding and formwork, the support system comprising two brackets according to one of aspects 1 to 16.

Aspect 18: A bridge overhang shielding and formwork comprising two brackets according to one of aspects 1 to 16, wherein the brackets are laterally spaced apart; and formwork positionable on the second telescoping support and spanning a distance between the two brackets to provide a horizontal support, wherein the first telescoping support is positionable on an outer side of a parapet on an elevated road surface with the attachment extension resting on a top of the parapet, and wherein the longitudinal extent of the first telescoping support is adjusted to position the formwork adjacent an underside of a bridge deck.

Aspect 19: A method for assembling a bridge overhang shielding and formwork, the method comprising attaching two brackets according to one of aspects 1 to 16 on a bridge parapet spaced apart from each other, wherein each of the two brackets is attached to a top surface of the bridge parapet by securing an attachment element through the aperture in the attachment extension of the first telescoping support into the top surface of the bridge parapet; adjusting the longitudinal extent of the first telescoping support so that the second telescoping support is positionable below a bottom surface of a roadway on the bridge and spaced apart therefrom; and adjusting the longitudinal extent of the second telescoping support so that a first end thereof extends beneath the roadway on the bridge.

Aspect 20: The method according to aspect 19, wherein adjusting the longitudinal extent of the first telescoping support comprises rotating a threaded nut engaged with one of the ends of the tensioning rod.

Aspect 21: The method according to aspect 19 or 20, wherein adjusting the longitudinal extent of the second telescoping support comprises moving the first segment axially within the second segment to adjust the longitudinal extent of the second telescoping support and positioning a fastener through aligned apertures in the first and second segments.

Aspect 22: The method according to aspects 19 to 21, wherein before each of the two brackets is attached to the top surface of the bridge parapet, a length of the attachment extension of the first telescoping support is adjusted to cover a substantial width of the top surface.

Aspect 23: The method according to aspects 19 to 22, wherein the attachment extension comprises first and second segments, wherein the first segment is moveable axially within the second segment to adjust the longitudinal extent of the attachment extension.

Aspect 24: The method according to aspects 19 to 23, comprising positioning formwork between respective second telescoping supports.

Aspect 25 The method according to aspects 19 to 24, comprising connecting opposing ends of a nailer board within outwardly extending hooks on the second segment of the first telescoping support, wherein the hooks are positioned adjacent opposing ends of the second segment: connecting an end of a guardrail in an upwardly directed pocket at the second end of the second telescoping support, wherein the pocket is configured to accept a guardrail positioned vertically; attaching side rails between the nailer board and the guardrail on each of the two brackets; and attaching side rails between the guardrails of respective brackets.

Various aspects of the support brackets and methods for forming a bridge overhang shielding and formwork using the support brackets may be illustrated with reference to one or more exemplary implementations or embodiments. As used herein, the term "exemplary" means "serving as an example, instance, or illustration," and should not necessarily be construed as preferred or advantageous over other variations of the devices, systems, or methods disclosed herein. "Optional" or "optionally" means that the subsequently described event or circumstance may or may not occur, and that the description includes instances where the event occurs and instances where it does not. In addition, the word "comprising" as used herein means "including, but not limited to".

Various aspects of the support brackets and bridge overhang shielding and formwork formed therefrom may be illustrated by describing components that are coupled, attached, and/or joined together. As used herein, the terms "coupled", "attached", and/or "joined" are interchangeably used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements shown in said examples.

Relative terms such as "lower" or "bottom" and "upper" or "top" may be used herein to describe one element's relationship to another element illustrated in the drawings. It will be understood that relative terms are intended to encompass different orientations of aspects of the support brackets in addition to the orientation depicted in the drawings. By way of example, if aspects of the support brackets shown in the drawings are turned over, elements described as being on the "bottom" side of the other elements would then be oriented on the "top" side of the other elements as shown in the relevant drawing. The term "bottom" can therefore encompass both an orientation of "bottom" and "top" depending on the particular orientation of the drawing.

As used herein, the term "substantially" may be taken to represent the inherent degree of uncertainty that may be attributed to any quantitative comparison, value, measurement, or other representation. Thus, the term substantially may mean an amount of generally at least about 80%, about 90%, about 95%, about 98%, or even about 99% of a stated value.

It must also be noted that as used herein and in the appended claims, the singular forms "a", "an", and "the" include the plural reference unless the context clearly dictates otherwise. Thus, for example, reference to "a" bracket, "an" attachment element, or "the" tensioning rod is a reference to one or more brackets, attachment elements, or tensioning rods and equivalents thereof known to those skilled in the art, and so forth. Unless defined otherwise, all technical and scientific terms used herein have the same meanings as commonly understood by one of ordinary skill in the art.

Words such as "then," "next," etc. are not intended to limit the order of the steps; these words are simply used to guide the reader through the description of the methods.

Moreover, while specific embodiments of the invention have been described in detail, it should be appreciated by those skilled in the art that various modifications and alternations and applications could be developed in light of the overall teachings of the disclosure. Accordingly, the particular arrangements, systems, apparatuses, and methods disclosed are meant to be illustrative only and not limiting as to the scope of the invention.

A list of the various elements shown in the drawings is provided in the table below.

| Reference Number | Element |
|---|---|
| 1 | bracket to support bridge overhang shielding and formwork |
| 2 | support beams |
| 3 | nailer beams |
| 4a | joists |
| 4b | platform |
| 5a | platform |
| 5b | joists |
| $\ell_1$ | longitudinal extent of second telescoping support 20 |
| $\ell_2$ | extension of second telescoping support 20 |
| $\ell_3$ | longitudinal extent of first telescoping support 10 |
| 10 | first telescoping support |
| 10a | first segment of the first telescoping support 10 |
| 10b | second segment of the first telescoping support 10 |
| 10c | tensioning rod |
| 12 | first end of the first telescoping support 10 |
| 12a | first end of the tensioning rod 10c |
| 12b | adjustment element at first end 12a of tensioning rod 10c |
| 14 | second end of the first telescoping support 10 |
| 14a | second end of the tensioning rod 10c |
| 14b | adjustment element at second end 14a of tensioning rod 10c |
| 16, 16' | attachment extension |
| 18 | attachment element |
| 20 | second telescoping support |
| 20a | first segment of the second telescoping support 20 |
| 20b | second segment of the second telescoping support 20 |
| 21a | adjustment apertures on first segment 20a |
| 21b | adjustment apertures on second segment 20b |
| 22 | first end of the second telescoping support 20 |
| 24 | second end of the second telescoping support 20 |
| 25 | girder |
| 26 | bridge deck |
| 27 | parapet |
| 30 | diagonal support beam |
| 32 | first end of the diagonal support beam 30 |
| 34 | second end of the diagonal support beam 30 |
| 40 | guardrail pocket |
| 42 | anchor plate |
| 44 | lifting ring |
| 46a | top nailer pocket |
| 46b | bottom nailer pocket |
| 47 | nailer beam |
| 60 | secondary attachment extension |
| 61a | first segment of attachment extension 16' |
| 61b | second segment of attachment extension 16' |
| 61c | tensioning rod of attachment extension 16' |
| 62 | adjustment element of attachment extension 16' |
| 100 | shielding |
| 102 | guardrail |

What is claimed is:

1. A bracket comprising:

a first telescoping support having an adjustable longitudinal extent defined by first and second ends, the first telescoping support comprising:

first and second segments, wherein the first segment is moveable axially within the second segment to adjust the longitudinal extent of the first telescoping support, a tensioning rod positioned within an interior of the first and second segments and extending through openings at opposing ends of the first and second segments, wherein each end of the tensioning rod includes an adjustment element configured to secure the longitudinal extent of the first telescoping support at a defined length, and an attachment extension positioned on the second segment adjacent the first end of the first telescoping support and extending perpendicularly therefrom, the attachment extension including an aperture configured to accept an attachment element; and a second telescoping support having an adjustable longitudinal extent defined by first and second ends, the second telescoping support attached to the first telescoping support perpendicular thereto, wherein the attachment extension is positionable on a top surface of a bridge parapet and connectable therewith by positioning the attachment element through the aperture in the attachment extension and into the top surface of the bridge parapet.

2. The bracket of claim 1, wherein each end of the tensioning rod is threaded, and the adjustment element comprises a threated nut configured to engage the ends of the tensioning rod.

3. The bracket of claim 1, comprising a diagonal support beam having a first end connected to the first telescoping support adjacent the second end thereof and a second end connected to the second telescoping support.

4. The bracket of claim 1, wherein the second segment of the first telescoping support comprises an anchor plate having apertures configured to accept an attachment element to secure the first segment to an outer vertical side of the parapet.

5. The bracket of claim 1, wherein the second telescoping support comprises:

first and second segments, wherein the first segment is moveable axially within the second segment to adjust the longitudinal extent of the second telescoping support.

6. The bracket of claim 5, wherein the second segment of the second telescoping support is attached to the first segment of the first telescoping support.

7. The bracket of claim 5, wherein the first segment of the second telescoping support comprises a plurality of apertures positioned along a longitudinal length thereof, and the second segment comprises an aperture adjacent a first end that is alignable with one of the plurality of apertures on the first segment, wherein the longitudinal extent of the second telescoping support is secured at a defined length by positioning a fastener through aligned apertures on the first and second segments.

8. The bracket of claim 7, wherein each end of the tensioning rod of the first telescoping support is threaded, and the adjustment element comprises a threated nut configured to engage the ends of the tensioning rod.

9. The bracket of claim 1, wherein the attachment extension comprises first and second segments, wherein the first segment is moveable axially within the second segment to adjust a longitudinal extent of the attachment extension.

10. The bracket of claim 9, wherein the attachment extension comprises a second tensioning rod positioned within an interior of the first and second segments and extending through openings at opposing ends of the first and second segments, wherein each end of the second tensioning rod includes an adjustment element configured to secure a longitudinal extent of the attachment element at a defined length.

11. The bracket of claim 1, wherein the second segment of the first telescoping support comprises an outwardly extending hook positioned adjacent opposing ends thereof, wherein the hooks are configured to connect a nailer board to the first telescoping support.

12. The bracket of claim 11, wherein the second telescoping support comprises an upwardly directed pocket at a second end thereof, wherein the pocket is configured to accept a guardrail.

13. A support system for a bridge overhang shielding and formwork, the support system comprising two brackets according to claim 1.

14. A bridge overhang shielding and formwork comprising:

two brackets according to claim 1 laterally spaced apart; and formwork positionable on the second telescoping support and spanning a distance between the two brackets to provide a horizontal support, wherein the first telescoping support is positionable on an outer side of a parapet on an elevated road surface with the attachment extension resting on a top of the parapet, and wherein the longitudinal extent of the first telescoping support is adjusted to position the formwork adjacent an underside of a bridge deck.

15. A method for assembling a bridge overhang shielding and formwork, the method comprising:

attaching two brackets according to claim 1 on a bridge parapet spaced apart from each other, wherein each of the two brackets is attached to a top surface of the bridge parapet by securing an attachment element through the aperture in the attachment extension of the first telescoping support into the top surface of the bridge parapet;

adjusting the longitudinal extent of the first telescoping support so that the second telescoping support is positionable below a bottom surface of a roadway on the bridge and spaced apart therefrom, and adjusting the longitudinal extent of the second telescoping support so that a first end thereof extends beneath the roadway on the bridge.

16. The method of claim 15, wherein adjusting the longitudinal extent of the first telescoping support comprises rotating a threaded nut engaged with one of the ends of the tensioning rod.

17. The method of claim 15, wherein adjusting the longitudinal extent of the second telescoping support comprises moving the first segment axially within the second segment to adjust the longitudinal extent of the second telescoping support and positioning a fastener through aligned apertures in the first and second segments.

18. The method of claim 15, comprising:

positioning formwork between respective second telescoping supports;

connecting opposing ends of a nailer board within outwardly extending hooks on the second segment of the first telescoping support, wherein the hooks are positioned adjacent opposing ends of the second segment;

connecting an end of a guardrail in an upwardly directed pocket at the second end of the second telescoping support, wherein the pocket is configured to accept a guardrail positioned vertically, attaching side rails between the nailer board and the guardrail on each of the two brackets; and attaching side rails between the guardrails of respective brackets.

19. The method of claim 15, wherein before each of the two brackets is attached to the top surface of the bridge parapet, a length of the attachment extension of the first telescoping support is adjusted to cover a substantial width of the top surface.

20. The method of claim 19, wherein the attachment extension comprises first and second segments, wherein the first segment is moveable axially within the second segment to adjust the longitudinal extent of the attachment extension.

* * * * *